US005097537A

United States Patent [19]

Ewing

[11] Patent Number: 5,097,537

[45] Date of Patent: Mar. 24, 1992

[54] DETACHABLE MULTISECTIONAL HOSIERY

[76] Inventor: Gloria M. Ewing, P.O. Box 2213, Toulca Lake, Calif. 91610-0213

[21] Appl. No.: 642,915

[22] Filed: Jan. 18, 1991

[51] Int. Cl.[5] ..... A41B 11/04

[52] U.S. Cl. ..... 2/409; 2/239; 2/240; 2/241; 2/242; 2/DIG. 9

[58] Field of Search ..... 2/409, 239, 240, 241, 2/242, DIG. 9

[56] References Cited

U.S. PATENT DOCUMENTS

| | | | |
|---|---|---|---|
| 319,131 | 6/1885 | Ryer | 2/239 |
| 3,249,110 | 5/1966 | Bryan | 2/409 |
| 3,253,599 | 5/1966 | Bjorn-Larsen | 2/409 |
| 3,466,667 | 9/1969 | Rosner | 2/239 |
| 3,678,514 | 7/1971 | Safrit | 2/212 |
| 3,845,506 | 11/1974 | Harris | 2/409 |
| 4,089,064 | 5/1978 | Chandler, Jr. | 2/2 |
| 4,267,607 | 5/1981 | Tino | 2/409 |
| 4,368,546 | 1/1983 | White | 2/239 |
| 4,903,345 | 2/1990 | Oakley | 2/409 |

*Primary Examiner*—Werner H. Schroeder
*Assistant Examiner*—Gloria Hale
*Attorney, Agent, or Firm*—Lyon & Lyon

[57] ABSTRACT

Multisectional hosiery having a plurality of various sections is connected by elastic attachment materials on each section in an overlapping manner. The multiple detachable hosiery sections allow the user to mix or match hosiery sections, or change the number of hosiery sections, to accommodate fashion desires, changes in clothing or a run in a particular hosiery section. The result is a versatile multisectional hosiery system which allows a user to use some of the various sections in many different combinations.

19 Claims, 1 Drawing Sheet

DETACHABLE MULTISECTIONAL HOSIERY

FIELD OF THE INVENTION

The present invention relates to hosiery, and more specifically, pantyhose.

BACKGROUND

Stockings have been a fashion apparel for women for decades. They have been made of nylon and silk, and other materials, to give a sheer appearance. Traditionally, they were held in place by garters. In time, pantyhose were invented to replace the garter. Pantyhose have the advantage of being sheer and form fitting, so they do not create unsightly bulk, as would a garter, in form-fitting apparel. Pantyhose also have the advantage of providing some support in the panty portion without being as restrictive as a girdle. Unfortunately, however, pantyhose are usually only manufactured and sold in four sizes: small, medium, large, queen and king sometimes by height. Thus, by necessity, ornamental selection is more limited in pantyhose than it is in stockings, which are still sold in a wide variety of ornamental designs.

In addition, traditional stockings and hosiery are made in one piece from one material. As is well known, when the wearer "runs" the stockings or panty hose (i.e., tears the hosiery material), the whole garment is rendered unsuitable. This results in a wasted material and expense, as even a small run may ruin an entire pair of panty hose or an entire stocking. Accordingly, there exists a long felt need for hosiery which is not entirely ruined when only one area has a run or tear.

Further, as Shakespeare said, "The fashion wears out more apparel than the man,"(Much Ado About Nothing, Act III, scene iii, line 147) although certainly the statement is applicable to persons regardless of gender. Hosiery in a single piece made from a single material does not permit changing the fashion without changing hosiery entirely —even if only a portion of the leg or only the ankle or foot is seen. Thus, even though the panty or upper leg or even lower leg or foot sections are not worn and are not seen, and may be perfectly usable, the wearer must change all sections of the hosiery just to change the fashion of what may be a small part. There thus exists a need for hosiery which may change in look or fashion without having to endure the expense and inconvenience of entirely changing hosiery itself.

SUMMARY OF THE INVENTION

The present invention relates to multisectional hosiery wherein a plurality of various sections are connected via elastic attachment means. The hosiery may be of a panty hose type style, or a stockings style, and may be of two or more sections. Each section may be of a different material or of similar materials. The materials themselves may provide for different functions, such as but not limited to, very elastic material for pregnant wearers, support hosiery materials, Spandex for athletic uses, or dressy materials such as patterned or variously colored nylon.

DETAILED DESCRIPTION OF THE DRAWINGS

DETAILED DESCRIPTION OF THE INVENTION

Figure 1:
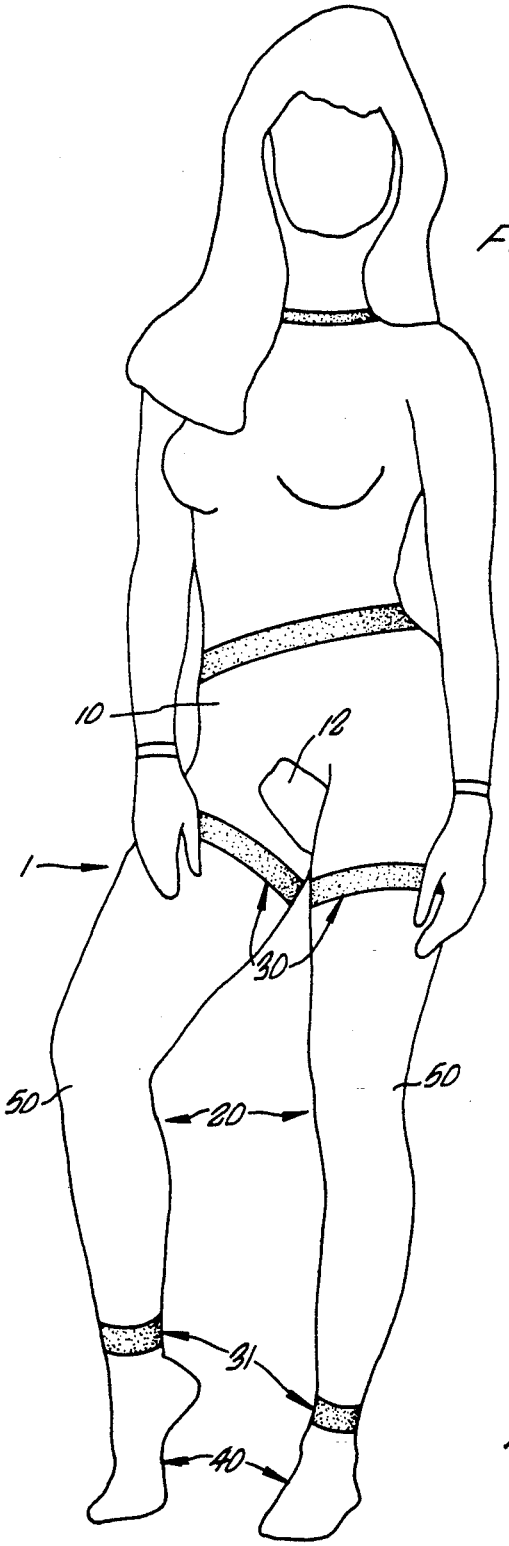
FIG. 1 represents one illustration of a multisectional hosiery garment according to the present invention.

The present multisectional hosiery may be embodied in a wide variety of different forms to accommodate a wide variety of uses and styles. Generally, to outline the different parameters, the style, number of sections, materials and means for attachment of one section to another may be selected according to the individual need. A preferred embodiment of a multisectional pair of detachable pantyhose according to the present invention, generally designated as 1, is depicted in FIG. 1. The pantyhose has a panty portion 10 and a pair of leg portions, generally designated as 20, which are detachably connected to the panty portion 10 by elastic means 30. In another preferred embodiment of the invention, each of the leg portions 20 has a foot portion 40 which is detachably connected to an upper leg portion 50 by additional elastic means, generally designated 31. As shown in FIG. 1, the foot portions 40 do not extend above the wearer's knee, but in another alternative embodiment (not shown), the foot portions 40 do extend above the wearer's knee.

Figure 2:
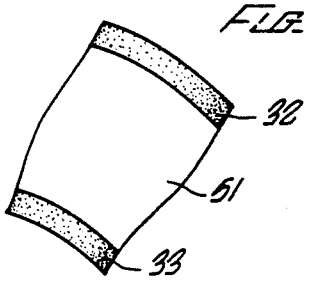
FIG. 2 represents a detachable hosiery section according to the present invention.

A preferred embodiment of a multisectional hosiery system according to the present invention, generally designated as 100, is depicted in FIG. 2. The system has a panty portion, generally designated as 10, a pair of upper leg portions 51, a pair of lower leg portions 61, and a pair of foot portions 40. The panty portion has a hosiery panty support portion 11, a crotch portion 12 (which can be made of a breathable material such as cotton) and a pair of leg portions 13, with a pair of elastic means to snugly fit a pair of legs. The pair of upper leg portions 51 have an upper leg hosiery portion 52 and a first and second upper leg portion elastic means, generally designated 32 and 33, respectively, to snugly fit a leg. The pair of lower leg portions 61 have a lower leg hosiery portion 62 and a first and second lower leg portion elastic means, generally designated 34 and 35, to snugly fit a leg. The pair of foot portions have a foot hosiery portion 41 and a foot portion elastic means, generally designated 36, to snugly fit a leg.

In the context of this invention, the panty portion 10 (excluding a crotch portion 12), the leg portions 20, the leg portions 13, the upper leg hosiery portions 13, the upper leg hosiery portion 52, the lower leg hosiery portion 62 and the foot hosiery portion 41 are all made of hosiery material. That is, the material is suitable as hosiery such as pantyhose and stockings, and not as some other garment, such as trousers, slacks or shorts. "Hosiery material" connotes the use of relatively flexible material, preferably fiber, such as nylon or silk, which is form fitting, and not baggy, inflexible fabrics. However, there are variations in hosiery material, and it is contemplated that preferred embodiments use several different materials for different parts of the pantyhose or multisectional hosiery system. For example, the panty may be of a full cut or a smaller cut, and made of various materials. Panty sections may be of a firmer nature, as what those skilled in the art call "control top." Leg sections may be seamed or unseamed, and foot sections may be sandal foot reinforced heels or toes or both. The materials also may be selected from a wide variety, recognizing that each section may be of the same material or different materials in combination. For example, maternity hosiery materials, support hosiery materials, surgical hosiery materials, different deniers of nylon materials, such as tights or sheer nylon, spandex, cotton-synthetic blends and other materials which are suitable for hosiery, may be selected. The wearer's selection may be based on health needs, such as for maternity, support, athletic needs, comfort needs, warmth or coolness of fabric. The wearer's selection may also be based on fashion needs, such as the selection of different colors or patterns, or different types of hosiery materials. For example, one may desire a maternity panty, and support upper thigh portion, but sheer over-the-knee section for style purposes.

Fashion hosiery material is another preferred embodiment. The use of multiple detachable sections in the present invention allows the wearer the advantages of mixing and matching various materials, including fashion or dressy hosiery materials. For example, patterned hosiery materials may be used, or plain dressy materials with a sparkling effect may be used. Also, designs, such as air-brushed or tie-dyed designs may be used. Generally, fashion hosiery material is that material which includes an arbitrary, or at least non-functional design for fashion purposes, as opposed to the knit of the material as a result of its manufacture alone. Many other examples apart from those listed above would be apparent to one of ordinary skill in the art working from the illustrative examples disclosed herein.

Figure 3:
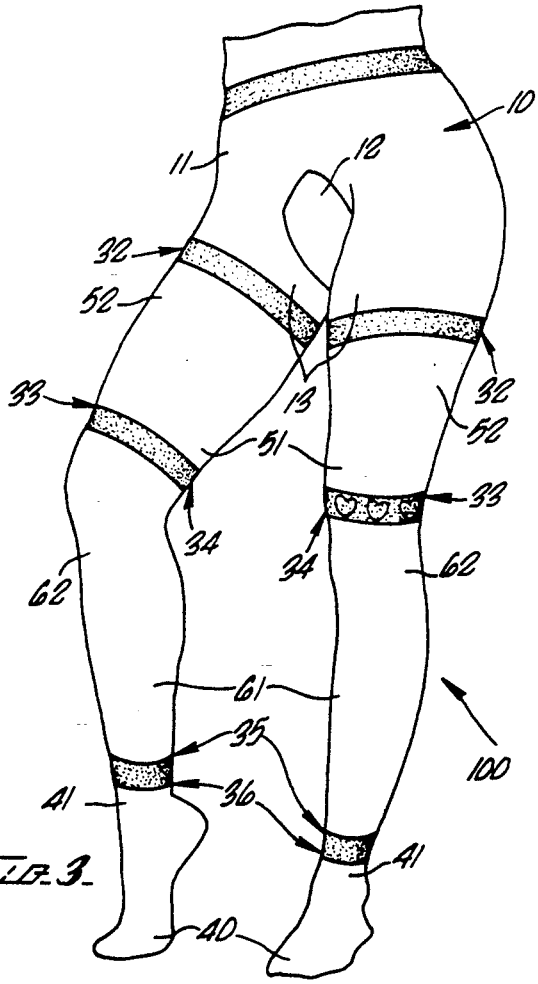
FIG. 3 represents another illustration of a multisectional hosiery garment according to the present invention.

The multiple detachable hosiery sections of the present invention include at least one elastic means on one border, and in some cases, such as the pair of upper leg portions 51 shown in FIGS. 2 and 3, two elastic means, 32 and 33, to snugly fit a leg. In a preferred embodiment, it is contemplated that the elastic means be of a somewhat sheer material, such as a spandex, so as to generally conform to the form of the hosiery section. The elastic means can also be a combination of materials, such as spandex and nylon. Thus, for example, previous hosiery articles such as knee or thigh highs have included such elastic means affixed to the non-elastic portion of the hosiery garment. The elastic portion of one hosiery section overlaps or connects two hosiery sections, and the overlap can be partial or complete. The elastic portion is preferably two to three inches, and may be of a separate elastic piece, or a knitted-in elastic piece, either flat or ribbed. In an especially preferred embodiment, one or more elastic piece too may be used to give a stylish effect, such as by using lace, or patterned materials for the elastic connection to create a decorative design portion. For example, decorations could include mushrooms, familiar sea shells, pine cones, familiar mammals, familiar birds, buds, roses and other familiar flowers, and cactus, etc.

Presented below are a few examples of the present invention:

EXAMPLE 1

SELECTED SUPPORT

If the wearer desires support hose material over the thigh and knee area only, the wearer would select (a) a regular panty (if panty hose type hosiery is desired) (b) a leg section covering the thigh and knee area made of support hose comprised of 70–85% nylon, the remainder being spandex, and (c) a calf-covering section of sheer hosiery material made of 100% nylon for fashion purposes.

EXAMPLE 2

REMOVABLE FOOT

If the foot section tends to wear out more quickly, the wearer may desire a replaceable anklet-type foot section. The wearer would select (a) a panty section (if panty type hosiery is desired), (b) a leg section or multi leg sections, and (c) a removable anklet section. If the hosiery is to be worn underneath slacks, the anklet section may further be ornamental for fashion purposes.

EXAMPLE 3

REMOVABLE KNEE-HIGH

If higher than an anklet is desired, the above anklet section may be replaced with a removable knee-high section.

EXAMPLE 4

STYLISH LEG SECTION

The wearer may desire a fashion in which the leg section is a different color, pattern, design or material than the foot section. In this case, the wearer would select (a) a panty section (if panty hose is desired), (b) a full length leg section made of ornamental material, and (c) an anklet made of different ornamental material. Style may be enhanced also by additional lace borders between sections, or other colors, patterns, designs or materials.

EXAMPLE 5

STYLISH ATHLETIC WEAR

For athletic use, a similar principle may be employed as above in that the panty and leg sections may be of different materials, and the foot section may be present or omitted.

EXAMPLE 6

EVERY DAY WEAR

For day-to-day wear, where the wearer simply seeks to replace worn out sections of hosiery without replacing the entire pair of panty hose or stockings, the wearer may select a single material for all sections. For example, the wearer may select an above-the-knee section of sheer skin-toned material, and a matching upper thigh/panty portion.

EXAMPLE 7

MATERNITY HOSE

The wearer may substitute a maternity panty section when suitable, and replace the panty with a regular panty section after giving birth without having to discard the entire pair of panty hose.

EXAMPLE 8

SUMMER WEAR

If the wearer does not desire to wear a panty portion made of hosiery material during the day, but still desires to wear a stocking, the panty portion could be replaced with a regular panty during the day. If the wearer subsequently wanted a panty portion made of hosiery material at night, the panty portion of this invention could then be substituted for the conventional panties.

As will be apparent to those skilled in the art in light of the preceding disclosure, many modifications, alterations, and substitutions are possible in the spirit of scope thereof. For example, in another preferred embodiment of the present invention, it is contemplated that the multisectional

I claim:

1. A multisectional pair of detachable pantyhose, comprising:

a panty portion; and a pair of leg portions detachably connected to the panty portion by elastic means.

2. A multisectional pair of detachable pantyhose as recited in claim 1, wherein each of the leg portions is comprised of a foot portion detachably connected to a upper leg portion by additional elastic means.

3. A multisectional pair of detachable pantyhose as recited in claim 2, wherein the foot portion does not extend above the knee.

4. A multisectional pair of detachable pantyhose as recited in claim 2, wherein the foot portion does extend above the knee.

5. A multisectional pair of detachable pantyhose as recited in claim 2, wherein the upper leg portion has a first decorative design and the foot portion has a second decorative design which is different from the first decorative design.

6. A multisectional pair of detachable pantyhose as recited in claim 2, wherein the upper leg portion is made of a first material and the foot portion is made of a second material which is different from the first material.

7. A multisectional pair of detachable pantyhose as recited in claim 2, wherein at least one elastic means contains a decorative design portion.

8. A multisectional pair of detachable pantyhose as recited in claim 1, further comprising an upper body portion detachably connected to the panty portion.

9. A multisectional pair of detachable pantyhose as recited in claim 8, wherein the upper body portion is detachably connected to the panty portion by elastic means.

10. A multisectional pair of detachable pantyhose as recited in claim 1, wherein the pair of leg portions are open ended.

11. A multisectional hosiery system, comprising:

a panty portion comprised of a hosiery panty support portion having two leg openings with elastic means, a crotch portion and a pair of leg portions each having elastic means to snugly fit around a pair of legs of a wearer;

wherein each leg portion has a first upper leg portion elastic means to snugly fit around a leg and at least partially overlap one of the pair of elastic means of the panty portion, a leg hosiery portion, and a second lower leg portion elastic means to snugly fit around a leg; and a foot portion comprised of a foot hosiery portion and a foot portion elastic means to snugly fit around a leg and at least partially overlap the second lower leg portion elastic means.

12. A multisectional hosiery system as recited in claim 11, wherein the leg hosiery portion is made of a first material and the foot hosiery portion is made of a second material which is different from the first material.

13. A multisectional hosiery system as recited in claim 11, wherein the leg hosiery portion has a first decorative design and the foot hosiery portion has a second decorative design which is different from the first decorative design.

14. A multisectional hosiery system as recited in claim 11, wherein the first leg portion elastic means substantially overlaps the elastic means of one of the pair of leg portions an leg portion elastic means substantially overlaps the foot portion elastic means.

15. A multisectional hosiery system as recited in claim 11, wherein one or more of the fist and second leg portion elastic means, the elastic means of one of the pair of leg portions and the foot portion elastic means contain a decorative design portion.

16. A multisectional hosiery system comprising:

a panty portion with a pair of leg openings having elastic means to snugly fit around a pair of legs;

a pair of upper leg portions comprised of a first upper leg portion elastic means to snugly fit around a leg and overlap one of the pair of elastic means of the panty portion, an upper leg hosiery portion, and a second upper leg portion elastic means to snugly fit a leg;

a pair of lower leg portions comprised of a first lower leg portion elastic means to snugly fit around a leg and overlap the second upper leg portion elastic means, a lower leg hosiery portion, and a second lower leg portion elastic means to snugly fit around a leg; and a pair of foot portions comprised of a foot hosiery portion and a foot portion elastic means to snugly fit around a leg and overlap the second lower leg portion elastic means.

17. A multisectonal hosiery system as recited in claim 16, wherein one member of a group consisting of the upper leg hosiery portion, the lower leg hosiery portion and the foot hosiery portion is made of a first material and a second member of the group is made of a second material which is different than the first material.

18. A multisectional hosiery system as recited in claim 16, wherein a first member of a group consisting of the upper leg hosiery portion, the lower leg hosiery portion and the foot hosiery portion has a first decorative design and a second member of the group has a second decorative design which is different than the first decorative design.

19. A multisectional hosiery system as recited in claim 16, wherein one or more of the pair of elastic means, the first and second upper leg portion elastic means, the first and second lower leg portion elastic means and the foot portion elastic means contain a decorative design portion.

* * * * *

UNITED STATES PATENT AND TRADEMARK OFFICE
CERTIFICATE OF CORRECTION

PATENT NO. : 5,097,537

DATED : March 24, 1992

INVENTOR(S) : Gloria M. Ewing

It is certified that error appears in the above-identified patent and that said Letters Patent is hereby corrected as shown below:

In column 5, line 6, after the word "multisectional", insert the following:

-- pair of detachable pantyhose would have a pair of leg portions without any foot or anklet portion, thus allowing the wearer to wear separate socks, which could be designed to match the pair of leg portions. In such an embodiment, the socks could be of nonhosiery material, such as 100% cotton. In still another preferred embodiment of the present invention, the multisection pantyhose could be part of a multisectional body stocking made of hosiery material which could be detachable at the waist with elastic means as shown in Figure 1 or could be a single piece from the shoulder or chest, which could be a halter top style or strapless, with or without sleeves, to the panty portion. In such an embodiment, the body stocking could be decorative and could replace the necessity for a camisole. Further, it is contemplated that such a body stocking could be designed to have a variety of detachable hosiery sections, and the upper body portions could optionally be made of a lace or decorative spandex or combination of spandex and nylon type of material. Accordingly, the invention is not intended to be limited except as may be required by the lawful scope of the following claims in view of the preceding disclosure. --

In column 6, line 16, change the word "an" to -- and --.

UNITED STATES PATENT AND TRADEMARK OFFICE

CERTIFICATE OF CORRECTION

PATENT NO. : 5,097,537
DATED : March 24, 1992
INVENTOR(S) : Gloria M. Ewing

It is certified that error appears in the above-indentified patent and that said Letters Patent is hereby corrected as shown below:

Column 6, line 16, after the word "and" insert --the second--.

Column 6, line 19, change the word "fist" to --first--

Signed and Sealed this

Sixteenth Day of November, 1993

Bruce Lehman

*Attest:*

BRUCE LEHMAN

*Attesting Officer*

*Commissioner of Patents and Trademarks*